US006751912B2

(12) United States Patent
Stegner et al.

(10) Patent No.: US 6,751,912 B2
(45) Date of Patent: Jun. 22, 2004

(54) MODULAR TILE AND TILE FLOORING SYSTEM

(75) Inventors: Michael W. Stegner, Windsor (CA); Brian Bondy, Emeryville (CA); Steven Reko, Windsor (CA); David Thornton, Windsor (CA); Michael Vermast, Essex (CA)

(73) Assignee: Spider Court, Inc., Windsor (CA)

( * ) Notice: Subject to any disclaimer, the term of this patent is extended or adjusted under 35 U.S.C. 154(b) by 0 days.

(21) Appl. No.: 10/059,563

(22) Filed: Jan. 29, 2002

(65) Prior Publication Data

US 2002/0189176 A1 Dec. 19, 2002

Related U.S. Application Data

(60) Provisional application No. 60/264,765, filed on Jan. 29, 2001, and provisional application No. 60/306,950, filed on Jul. 20, 2001.

(51) Int. Cl.[7] ..... E04F 11/16; E04B 2/18

(52) U.S. Cl. ..... 52/177; 52/591.1; 52/591.2

(58) Field of Search ..... 52/177, 591.1, 52/591.2, 581, 179–181, 578, 580, 588.1, 589.1, 590.1, 590.2, 590.3, 591.5, 592.1–592.6; 403/292–298, 345

(56) References Cited

U.S. PATENT DOCUMENTS

| | | | | |
|---|---|---|---|---|
| 1,501,739 A | | 7/1924 | Benedek | |
| 2,503,174 A | | 4/1950 | Salvadore | |
| 3,699,926 A | | 10/1972 | Stockl | |
| 3,795,180 A | | 3/1974 | Larsen | |
| 3,911,190 A | | 10/1975 | Myers et al. | |
| 3,922,409 A | | 11/1975 | Stark | |
| 4,054,987 A | | 10/1977 | Forlenza | |
| 4,109,439 A | | 8/1978 | Feasel | |
| 4,167,599 A | | 9/1979 | Nissinen | |
| 4,226,064 A | * | 10/1980 | Kraayenhof | 52/180 |
| 4,287,693 A | | 9/1981 | Collette | |
| 4,436,779 A | | 3/1984 | Menconi et al. | |
| 4,478,901 A | | 10/1984 | Dickens et al. | |
| 4,512,044 A | | 4/1985 | Clark | |
| 4,584,221 A | * | 4/1986 | Kung | 428/44 |
| 4,727,697 A | | 3/1988 | Vaux | |
| 4,860,510 A | | 8/1989 | Kotler | |
| 4,930,286 A | | 6/1990 | Kotler | |
| 5,628,160 A | * | 5/1997 | Kung | 52/591.1 |
| 5,904,021 A | | 5/1999 | Fisher | 52/578 |
| 5,950,378 A | | 9/1999 | Council et al. | 52/177 |
| 6,098,354 A | | 8/2000 | Skandis | |
| 6,128,881 A | * | 10/2000 | Bue et al. | 52/582.2 |
| 6,170,212 B1 | * | 1/2001 | Suchyna et al. | 52/480 |
| 6,451,400 B1 | * | 9/2002 | Brock et al. | 428/44 |
| 6,467,224 B1 | * | 10/2002 | Bertolini | 52/177 |
| 6,526,705 B1 | * | 3/2003 | MacDonald | 52/177 |

FOREIGN PATENT DOCUMENTS

| | | |
|---|---|---|
| DE | 9407901 | 8/1994 |

* cited by examiner

*Primary Examiner*—Jeanette Chapman
(74) *Attorney, Agent, or Firm*—Howard & Howard

(57) ABSTRACT

A tile flooring system composed of modular interlocking tiles. Each modular interlocking tile is adapted to be coupled to another modular interlocking tile. Each tile includes a body having a playing surface, two male interlocking sides, and two female interlocking sides. Each also tile includes an interlocking mechanism coupled to the male interlocking sides and the female interlocking sides. The interlocking mechanism is adapted to allow the modular interlocking tile to be connected to the another modular interlocking tile in a staggered fashion.

30 Claims, 8 Drawing Sheets

MODULAR TILE AND TILE FLOORING SYSTEM

This application claims priority to U.S. Provisional applications, Serial No. 60/264,765 filed Jan. 29, 2001 and No. 60/306,950 filed Jul. 20, 2001.

FIELD OF THE INVENTION

The subject invention relates to flooring, and in particular to modular flooring comprised of interlocking sections. More particularly, the present invention relates to modular tiles of plastic composition which are interlocked to form a playing surface having a wide range of uses.

BACKGROUND OF THE INVENTION

Modular tile flooring is used in various ways for overlaying a foundational flooring to improve the aesthetics and/or functionality of the floor in homes or building. The modular flooring may also be designed for a specific purpose, such as an indoor football or soccer field, a softer foundation for reduction of leg weariness during operations where people have to stand for particularly extended periods of time, or other specific use. In the use of such flooring, the range of use is often limited. Furthermore, the smoothness of the surface is limited, particularly if a low cost production technique, such as injection molding, is used. In addition, tiles which interlock in a grid configuration, wherein each side of a tile aligns fully with a side of adjacent tiles, can easily become disengaged during play. Further, detachment of two tiles in a grid configuration can lead to detachment of an entire row of tiles. If the interlocking tiles provide for a staggered configuration, this disengagement will occur less often, and disengagement of two adjacent tiles is less likely to cause detachment of a row.

It is therefore a general object of the invention to provide a modular interlocking tile allowing for a staggered configuration which can be used in an interlocking flooring system having a range of uses, including within the range of uses a smooth surface capable of use as an in-line skating rink.

SUMMARY OF THE INVENTION AND ADVANTAGES

The modular interlocking tile of the present invention has a surface that is far more friction resistant than anything previously known, such that it can be used at one end of its range as an in-line skating rink. The modular tile is capable of having a highly frictionless surface as well as interlocking in a manner that maintains the smoothness of the surface between tile sections in every direction. By interlocking in a staggered configuration, the tiles have a higher likelihood of remaining in position during play. The tile is also capable of many other uses, and can be readily modified to provide significant friction on its surface by roughening the surface of the tiles. Preferably this roughening would be performed in the mold at the time of production, but the tile may also be modified subsequent to production with a post production technique. Thus, the present invention has a multi-purpose range of uses, as well as including within its versatile range of uses a system with a good friction coefficient without sacrificing speed of a user on the floor system. It can be used on inline hockey or other inline skating environments both indoor and outdoor, as well as basketball, volleyball, lacrosse, aerobics, racquet sports, locker room and shower floors. Non-athletic applications include decks and other structures.

The flooring system also has the advantages of being scuff resistant, portable, durable, easy to replace, water/moisture resistant, easy to clean and maintain, totally hygienic, and easy to retrofit over any existing surface. The flooring system may also be removable and replaceable if desired, for example, by a multi-use facility.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 3:
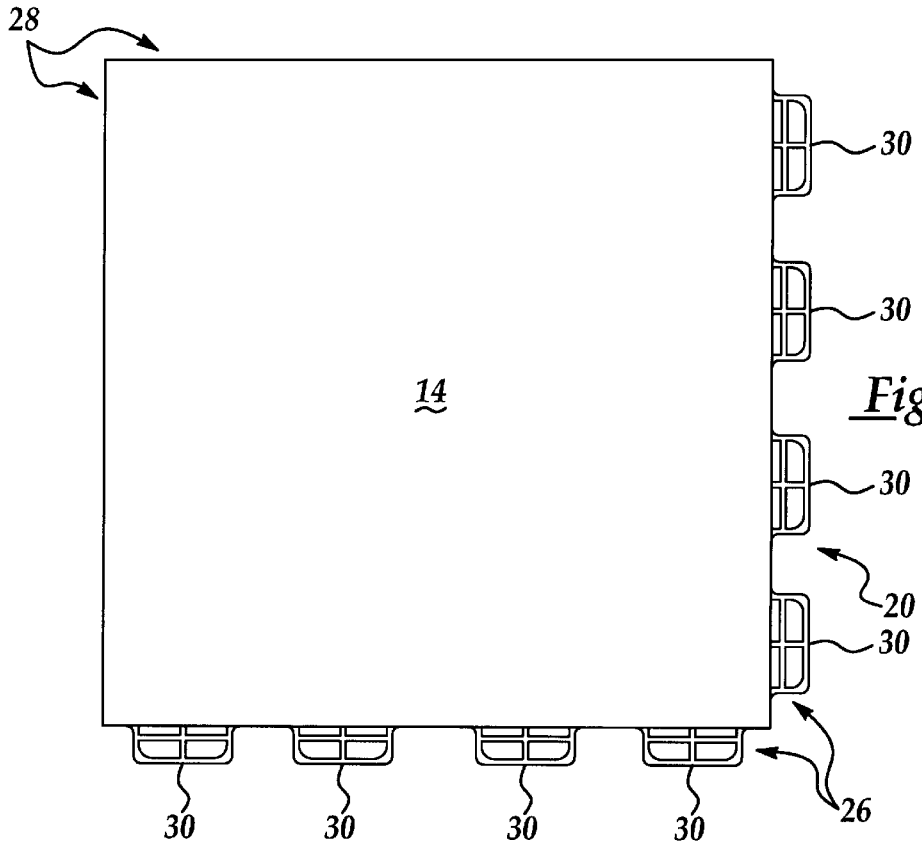
FIG. 3 is a top view of the tile of FIG. 2, according to an embodiment of the present.

With reference to the Figures and in operation, the present invention provides a modular tile 20 for use as tile flooring system 10. With specific reference to FIGS. 1A–1D, one exemplary use of the tile flooring system 10 is a sports arena, shown as an in-line skating rink 12. An in-line skating rink 12 needs a surface that has enough of a friction coefficient that the in-line skates can perform, yet have as little friction as possible so that the puck used for the sport can emulate the puck of an ice hockey game as much as possible. Thus, the puck needs to travel on a smooth, wear-resistant surface. With reference to FIG. 3, the modular tile 20 includes a body 21 with a playing surface 14. When assembled (see below) flooring system 10 is composed of a plurality of modular tiles 20. The playing surface 14 of the plurality of tiles 20 compose the surface of the sports arena or skating rink 12.

Figure 1A:
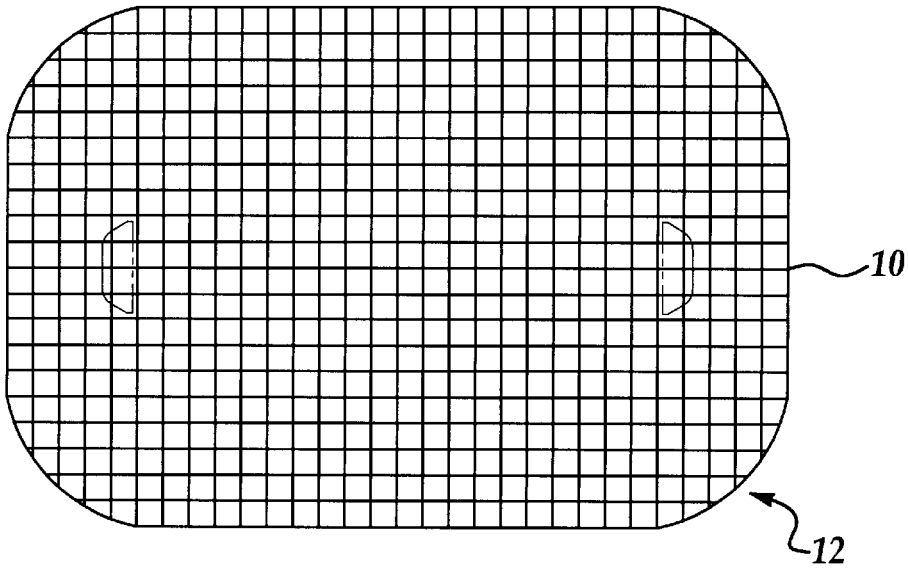
FIG. 1A is a top down drawing of an in-line skating rink in use as an in-line hockey facility where the present invention may be utilized.
Figure 1B:
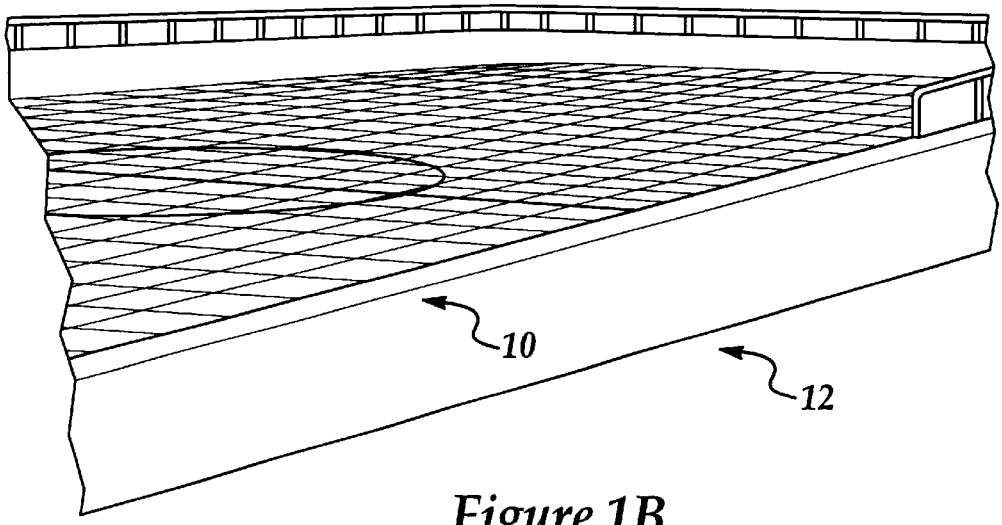
FIG. 1B is a first diagrammatic illustration of the in-line skating rink of FIG. 1A during use.
Figure 1C:
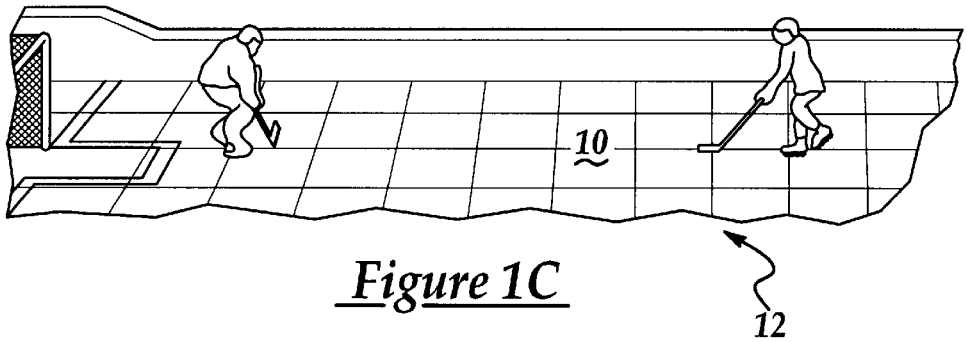
FIG. 1C is a second diagrammatic illustration of the in-line skating rink of FIG. 1A during use.
Figure 1D:
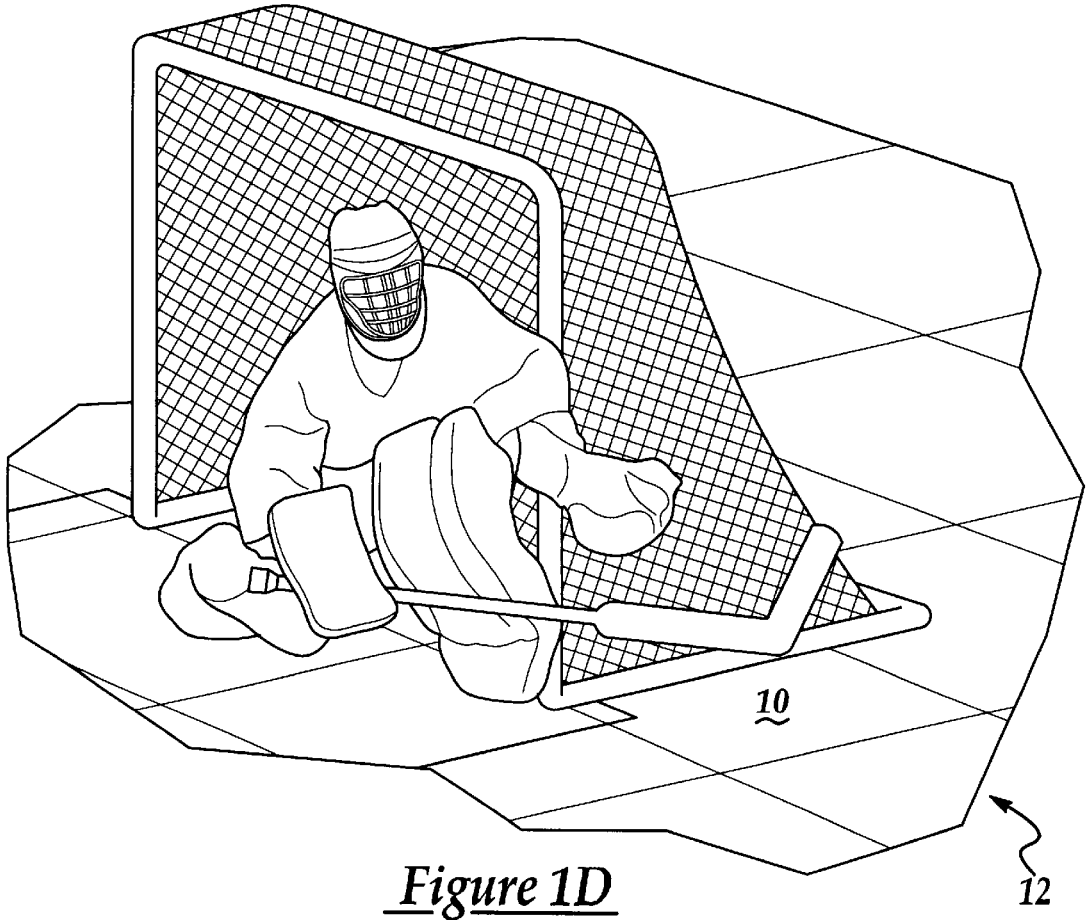
FIG. 1D is a third diagrammatic illustration of the in-line skating rink of FIG. 1A during use.
Figure 2:
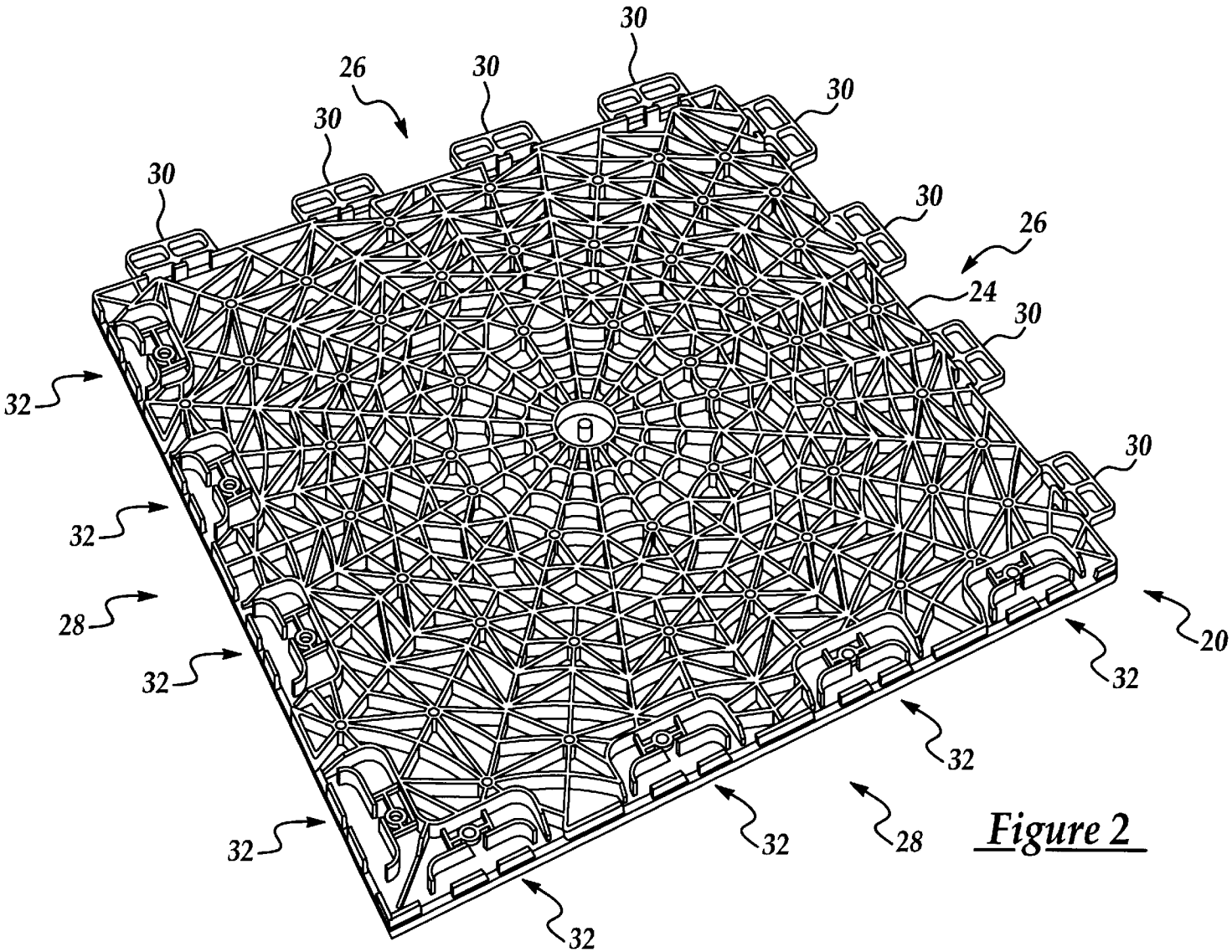
FIG. 2 is a perspective view of a modular interlocking tile, according to an embodiment of the present invention.
Figure 4:
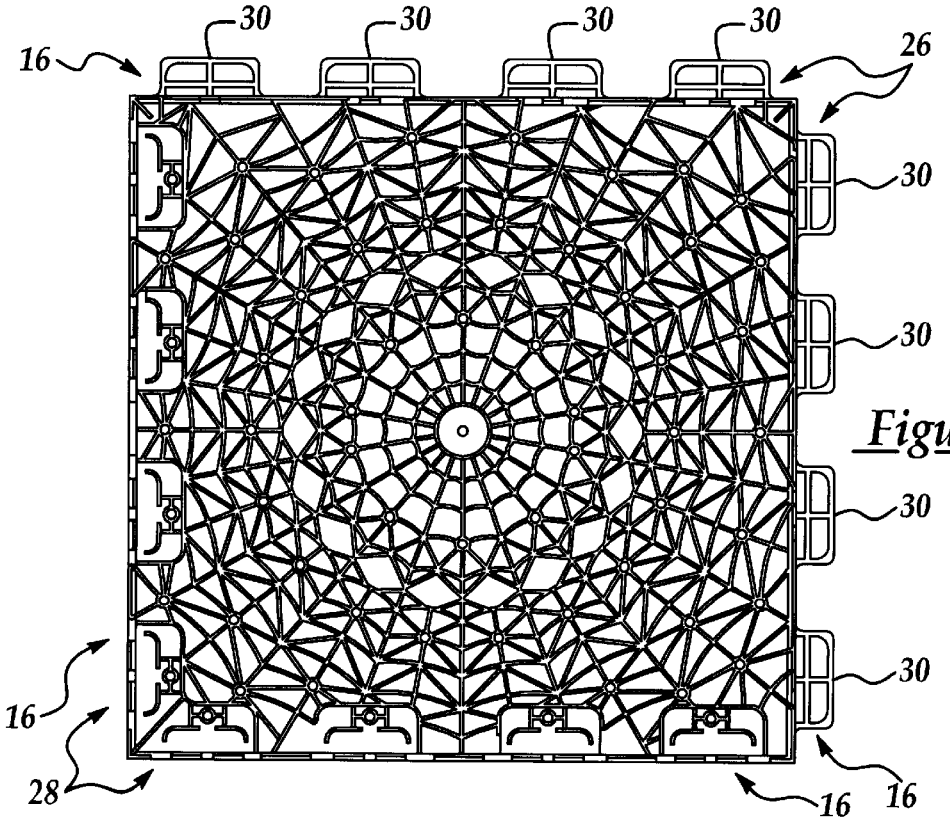
FIG. 4 is a bottom view of the tile of FIG. 2, according to an embodiment of the present invention.

With reference to FIGS. 2 and 4, the playing surface 14 of the modular tile 20 of the present invention is a dimple free surface due to a support construction 22 on the reverse side of the playing surface 14 permitting support for the plastic throughout the molding process. In one embodiment, the support construction 22 has a spider or spider web-shaped design, as shown.

Additionally, the modular tiles 20 includes an interlocking mechanism 16. The interlocking mechanism 16 is constructed such that the modular tiles 20 fit together tightly without any unevenness between the tiles 20, such that the entire surface of the interlocking tiles 20 can be maintained with a substantially consistent friction coefficient throughout the playing surface including the connection points of adjacent tiles 20. Furthermore, the interlocking mechanism 16 allows the modular tiles 20 to be assembled in a nonlinear pattern, e.g., staggered (see below).

The design of the individual tiles is shown in FIGS. 2, 3 and 4. The rear of the tile (FIG. 4) has a decorative spider web configuration 22 contained within an outer edge 24 as illustrated. The degree of support on the reverse of the configuration minimizes the dimpling caused by injection molding on a smooth surface, while still allowing injection of more material into the surface for better wear resistance. While the decorative web design 22 is deemed to be the best mode at this time by the inventors to accomplish this function, other designs may also be used to accomplish such a function.

The preferred mix of materials varies by color, but includes a mixture with a base Montel SB-821 polypropylene of a Clariant Hydrocerol CF-40-E foaming agent of three percent (3%) by volume and includes a range in the recipe for a color mix of two percent by volume if Dark Blue, White or Black; three percent by volume if Light Blue; and four percent by volume if Yellow, Green, or Red. Other colors or combinations of colors would have similar percentages. Thus, the tiles 20 themselves can be provided in virtually any color requested by a purchaser. The optimum size found for the tiles 20 is a twelve inch square playing surface, which also contributes to an ease of installation and ease of determination of how many tiles 20 are needed for a given area. While the tiles 20 may be painted to establish the lines of the hockey rink, different colored tiles 20 may also be used to establish such things as the center red line and the blue lines of an ice hockey surface for an ice hockey rink.

Each tile 20 has two male interlocking sides 26 and two female interlocking sides 28. To connect the tiles 20, at least one extension 30 from the male side 26 of a first tile 20' is received by at least one catch 32 from the female side 28 of a second tile 20" as described herein below. In one aspect of the present invention, each male interlocking side 26 has a plurality of extensions 30, e.g., 3 or 4 and each female side 28 has a corresponding number of catches 32.

Figure 5:
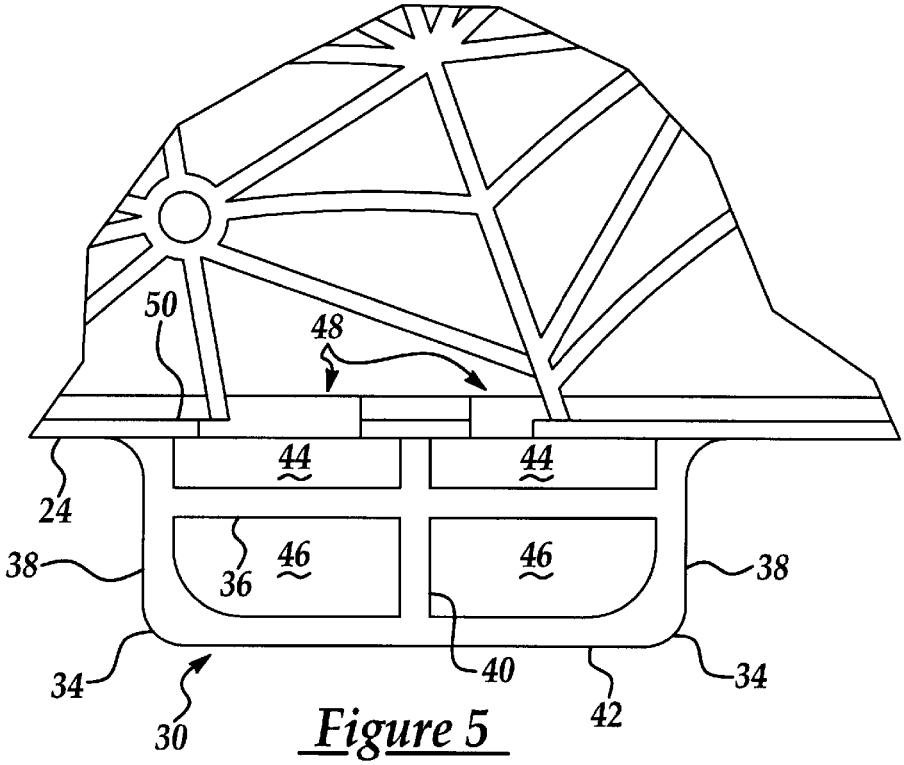
FIG. 5 is a bottom view of an extension of a male connecting side of the tile of FIG. 2, according to an embodiment of the present invention.
Figure 6:
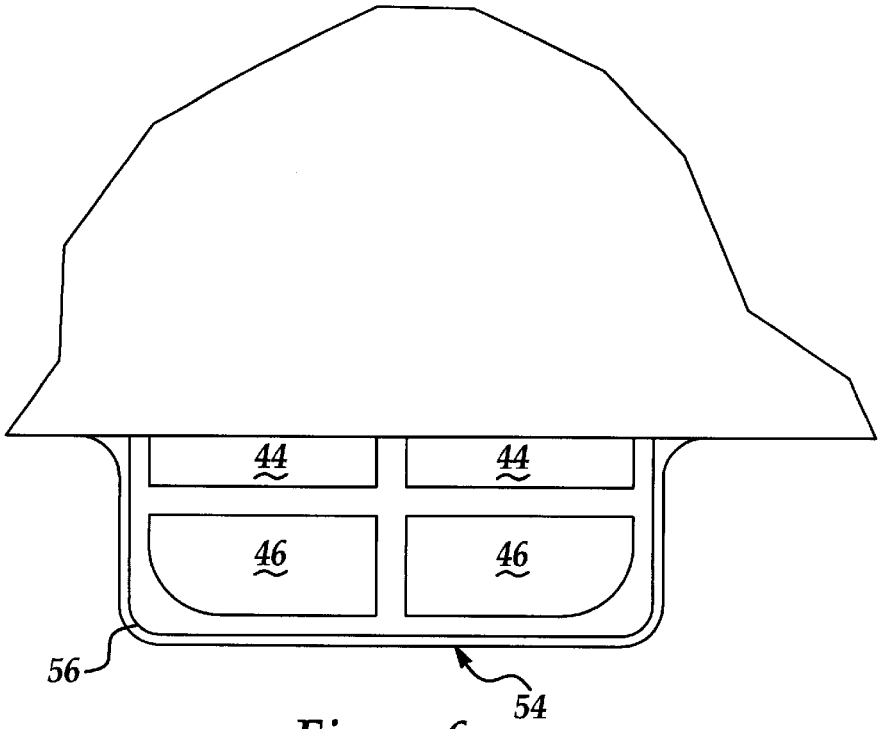
FIG. 6 is a top view of the extension of FIG. 5, according to an embodiment of the present invention.

Referring to FIGS. 5 and 6, in the embodiment illustrated each male interlocking side 26 is essentially identical and includes four equally spaced extensions 30 having substantially identical features. Each extension 30 is predominately rectangular in shape having rounded edges 34 at the corners furthest from the center of the tile 20. A first bar 36 connects the two shorter sides 38 of the rectangular extension near the connection between the tile 20 and the extension 30, creating approximately a 90 degree angle between the first bar 36 and each shorter side 38. A second bar 40 bisects the longer side 42 of the rectangular extension, intersects the first bar 36 at approximately a 90 degree angle, and connects to the tile 20 on the rear side of the tile 20 where the extension meets the tile 20. The perpendicular intersection of the first bar 36 and the second bar 40 creates two first openings 44 and two second openings 46. Each opening 44, 46 is substantially rectangular in shape. The two first openings 44 are those located closest to the center of the tile 20, while the two second openings 46 are furthest from the center of the tile 20. In the preferred embodiment, wherein the first bar 36 connects the two shorter sides 38 of the rectangular extension 30 below the midpoint, the two first openings 44 have a substantially smaller width than the two second openings 46. Two notches 48 in the outer edge 24 of the tile are located within the outer wall 50 of the two first openings for receiving tabs 52 from the female side 28 for connection. On the front side of the tile 20, a T-shaped member 54 molds to the first bar 36 and a portion of the second bar 40 to reinforce the extension 30. The position of the T-shaped member 54 creates a ridge 56 along the perimeter of each of the four rectangular openings 44, 46.

Figure 8:
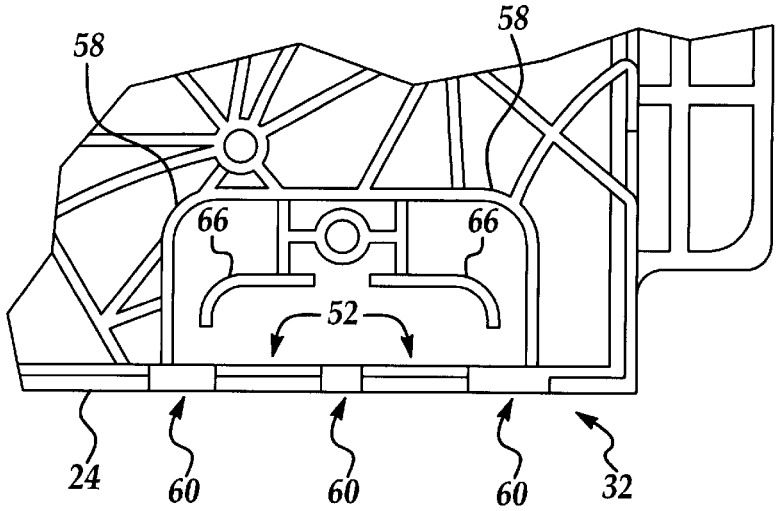
FIG. 8 is a perspective bottom view of a catch of a female connecting side of the tile of FIG. 2, according to an embodiment of the present invention.
Figure 9:
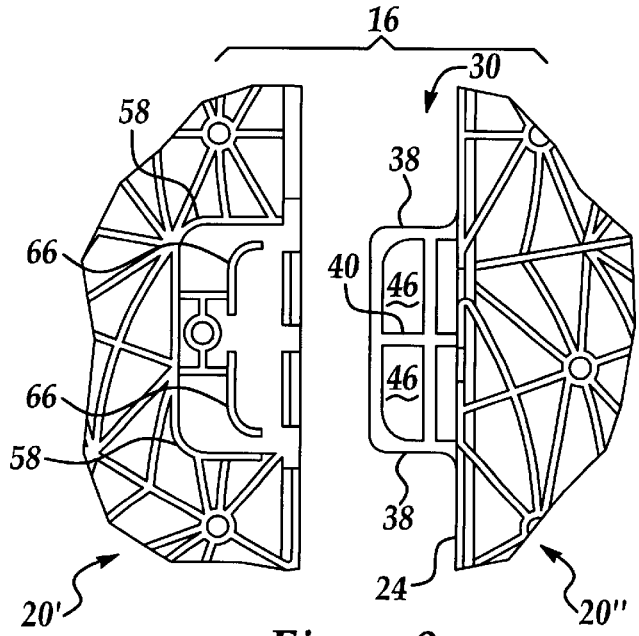
FIG. 9 is a perspective bottom view of one of the connecting mechanisms of the modular tiles of the present invention just before connection.
Figure 10:
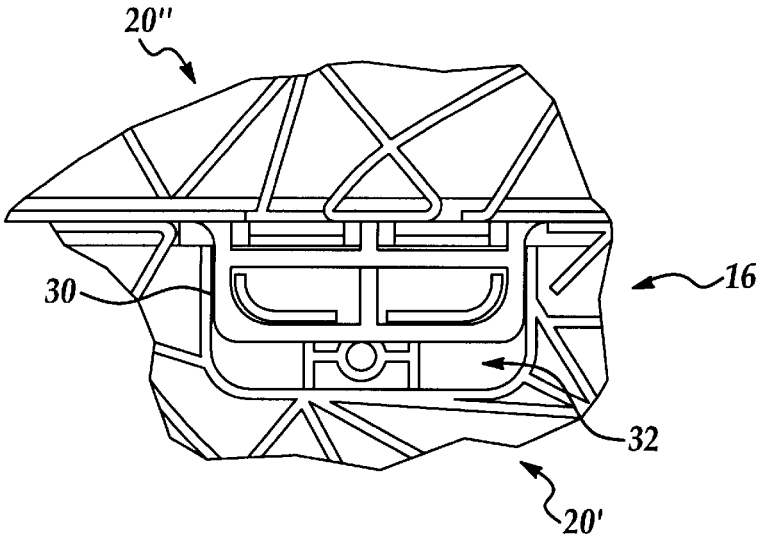
FIG. 10 is a perspective bottom view of a connected connecting mechanism.
Figure 11:
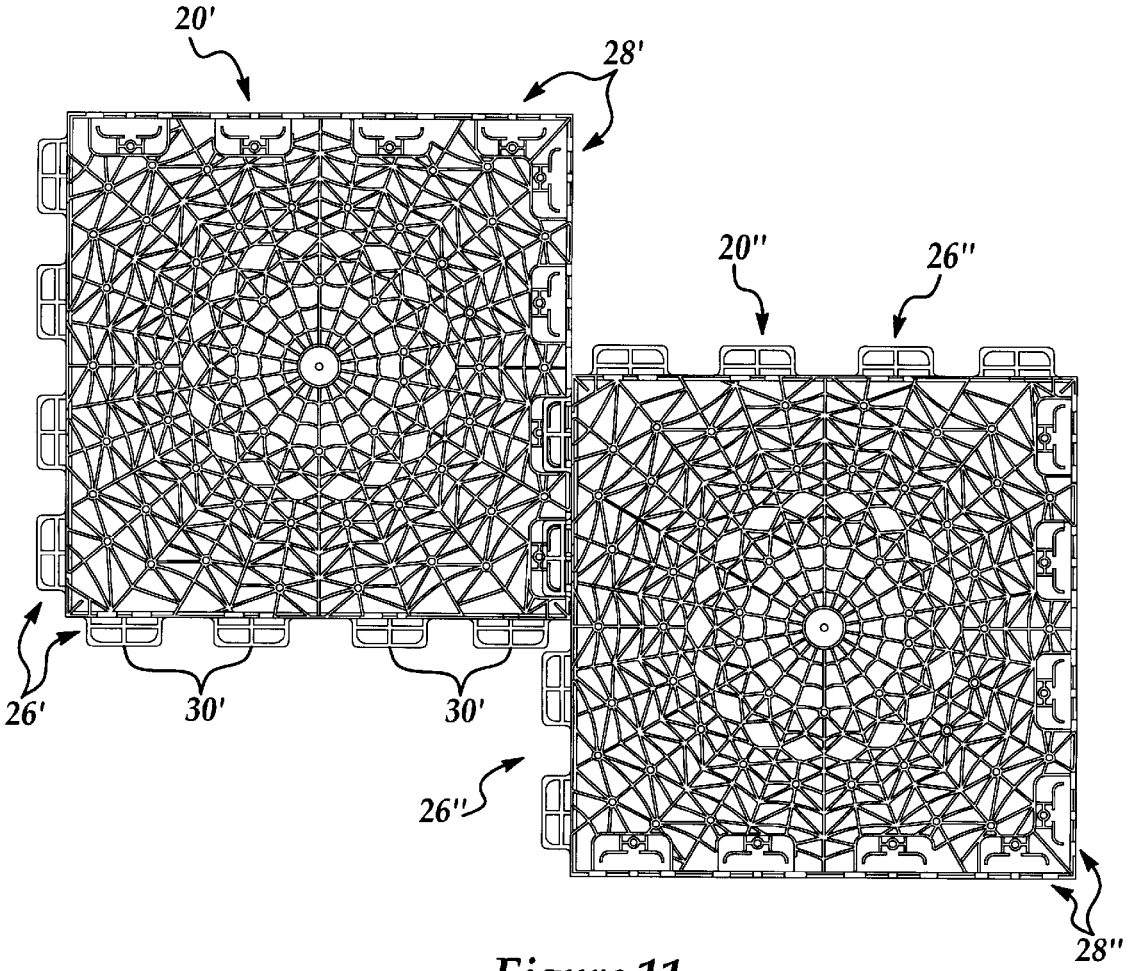
FIG. 11 is a perspective top view of a pair of tiles connected together in a staggered configuration, wherein two connections are made between the tiles.
Figure 12:
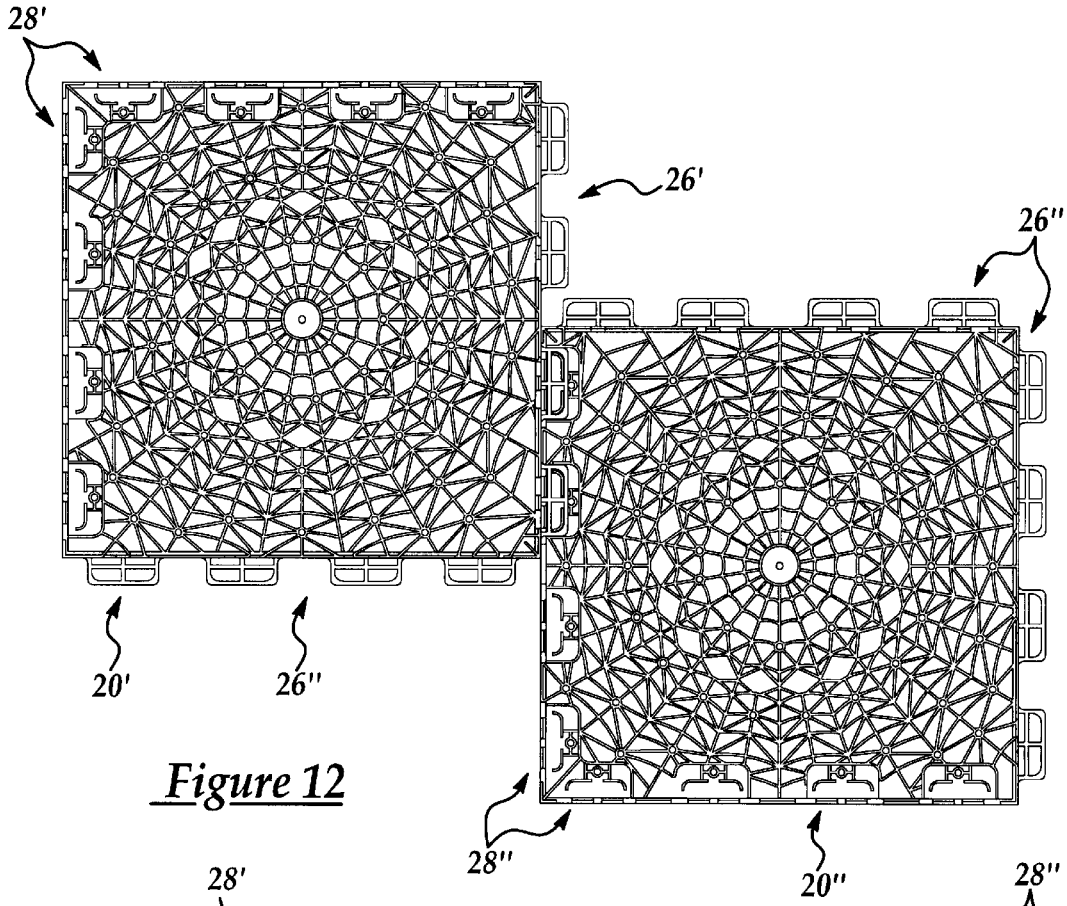
FIG. 12 is a perspective bottom view of a pair of tiles connected together in a staggered configuration, wherein two connections are made between the tiles.

Each female side 28 is substantially identical to other female sides 28, thereby allowing a uniform connection between different tiles 20. Each female side 28 includes four equally spaced catches 32 on the rear side of the tile 20. Referring to FIG. 8, each catch 32 is substantially rectangular in shape with two corners 58 closest to the center of the tile being rounded. The outer edge 24 of the tile 20 forms one side of the catch 32, and includes three openings 60 for receiving the two shorter sides 38 and second bar 40 from an extension 30 of a male side 26 for connection.

Figure 7:
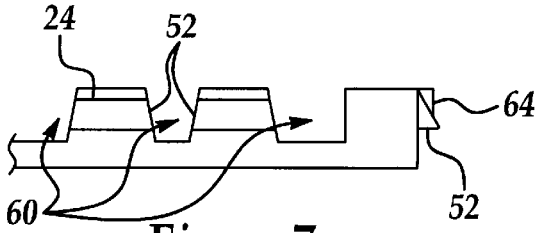
FIG. 7 is a vertical cross-section of a catch showing a tab and the angle between the tab and an outer edge of the tile.

Two tabs 52 having flat bottoms 62 project from the outer edge 24 of the tile 20 between the three openings 60. The tabs 52 extend away from the tile 20 at an angle 64 as shown in FIG. 7, and fit snugly inside the two first openings 44 in the extension of the male side 26 to securely connect two adjacent tiles 20. Two arms 66 are included inside each catch 32 which fit inside the two second openings 46 on the extension 30 of the male side 26 for supporting the extension 30 when the tiles 20 are connected. In the preferred embodiment, each arm 66 contacts the two notches 48 of the second opening 46 inside which it fits. However, other configurations of the arm 66 are possible.

Figure 13:
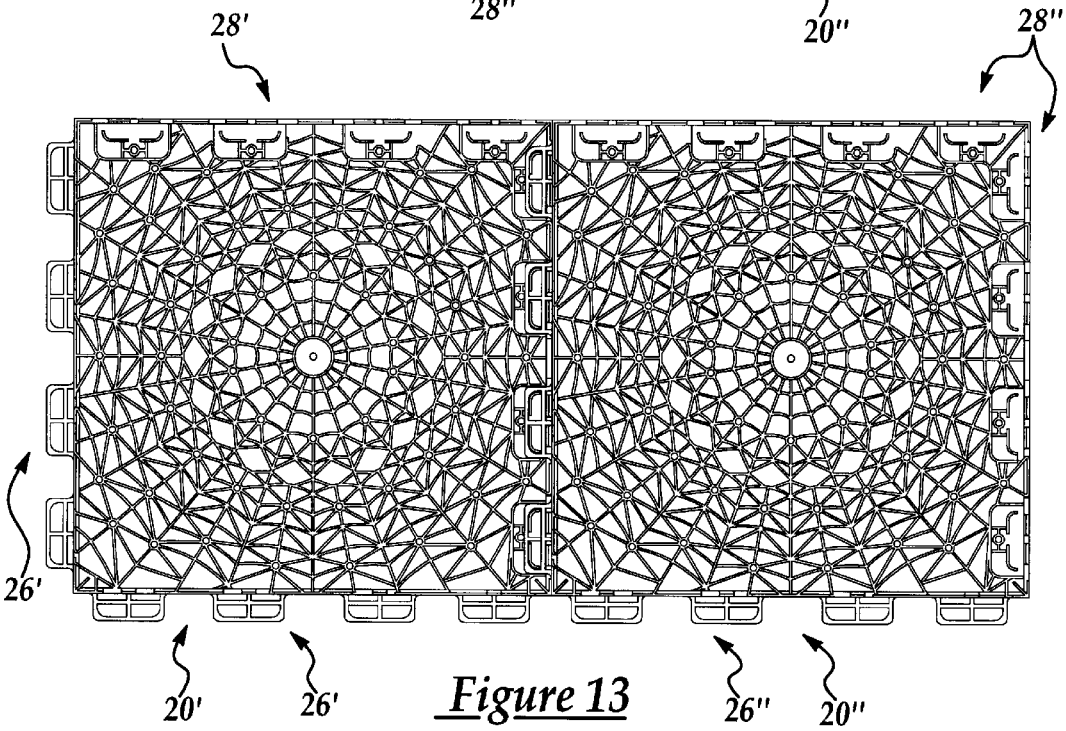
FIG. 13 is a perspective bottom view of a pair of tiles connected together in a non-staggered configuration, wherein four connections are made between the tiles.

As each side of the tile 20 includes four connection points, i.e. either four extensions 30 or four catches 32, it is possible to create a staggered configuration of the tiles wherein the outer edge 24 of the first tile 20' is aligned with the outer edge 24 of the second adjacent tile 20" at the midpoint of each by connecting the tiles 20', 20" at two of the four connection points (FIGS. 9, 10, 11 and 12). For example, if each tile 20 is twelve inches square, the first tile 20' and the second tile 20" will be offset by six inches. While the preferred embodiment includes this staggered configuration, it is also possible for the first tile 20' and the second tile 20" to connect at one, three, or four of the connection points, thereby creating a staggered configuration in which each tile 20 is offset by three or nine inches, as in FIGS. 7 and 8, or a non-staggered configuration as in FIG. 13.

Other advantages and further disclosure can be determined from the appended drawings.

What is claimed is:

1. A modular interlocking tile for use in a tile flooring system, the modular interlocking tile being adapted to be coupled to another modular interlocking tile, comprising:

a body having a playing surface, two male interlocking sides, and two female interlocking sides; and, an interlocking mechanism coupled to the male interlocking sides and the female interlocking sides, wherein the interlocking mechanism is adapted to allow the modular interlocking tile to be connected to the another modular interlocking tile in a staggered fashion, the interlocking mechanism including at least two extensions on each male interlocking side and at least two catches on each female interlocking side, each extension having a generally rectangular shape and including first and second bars and two shorter sides, the first bar connecting the two shorter sides near a connection between the file and the extension, the extension also including a longer side connected to an end of each shorter side, a first end of the second bar bisecting the longer side and a second end of the second bar being connected to the tile, the second bar further intersecting the first bar.

2. A modular interlocking tile, as set forth in claim 1, wherein corners of the extensions furthest from a center of the tile are rounded.

3. A modular interlocking tile for use in a tile flooring system, the tile for being connected to at least one other interlocking tile, comprising:

a body having a playing surface, two male interlocking sides, and two female interlocking sides; and, an interlocking mechanism coupled to the male interlocking sides and the female interlocking sides, the interlocking mechanism for allowing the modular interlocking tile to be connected to the at least one other interlocking tile in a staggered fashion, the interlocking mechanism includes at least two extensions on each male interlocking side and at least two catches on each female interlocking side, the extensions having a generally rectangular shape and, including two first openings and two second openings.

4. A modular interlocking tile, as set forth in claim 3, wherein the first openings and the second openings are substantially rectangular in shape.

5. A modular interlocking tile, as set forth in claim 4, further including a notch in an outer edge of the tile located within each first opening.

6. A modular interlocking tile, as set forth in claim 5, wherein each catch is substantially rectangular in shape.

7. A modular interlocking tile, as set forth in claim 6, wherein corners of the catches closest from a center of the tile are rounded.

8. A modular interlocking tile, as set forth in claim 6, wherein an outer edge of the tile within each catch includes three openings adapted to receive one of the extensions of the another modular interlocking tile.

9. A modular interlocking tile, as set forth in claim 8, wherein each catch includes at least one tab projecting from the outer edge of the tile.

10. A modular interlocking tile, as set forth in claim 9, wherein the at least one tab is adapted to securely fit into a first opening of the one of the extensions of the another modular interlocking tile.

11. A modular interlocking tile, as set forth in claim 10, wherein each catch includes at least one arm.

12. A modular interlocking tile, as set forth in claim 11, wherein the at least one arm is adapted to securely fit into a second opening of the one of the extensions of the another modular interlocking tile.

13. A modular interlocking tile, as set forth in claim 1, wherein the interlocking mechanism includes:

four extensions on each male interlocking side; and, four catches on each female interlocking side.

14. A modular interlocking tile, as set forth in claim 1, wherein the body includes a support construction on a side opposite the playing surface.

15. A modular interlocking tile, as set forth in claim 1, wherein the body includes a spider-web shaped construction on a side opposite the playing surface.

16. A modular interlocking tile, as set forth in claim 1, wherein the tile is composed with a mixture of materials having a base of Montel SB-821 polypropylene of a Clariant Hydrocerol CF-40-E foaming agent of three percent by volume.

17. A tile flooring system, comprising: first and second modular interlocking tiles, each modular interlocking tile having a playing surface, two male interlocking sides, and two female interlocking sides;

an interlocking mechanism coupled to the male interlocking sides and the female interlocking sides of each modular interlocking tile, wherein the interlocking mechanism is adapted to allow the modular interlocking tiles to be connected to the another modular interlocking tile in a staggered fashion, the interlocking mechanism including at least two extensions on each male interlocking side and at least two catches on each female interlocking side, the extensions having a generally rectangular shape, wherein the extensions include two first openings and two second openings.

18. A tile flooring system, as set forth in claim 17, wherein the first openings and the second openings are substantially rectangular in shape.

19. A tile flooring system, as set forth in claim 18, further including a notch in an outer edge of the tile located within each first opening.

20. A tile flooring system, as set forth in claim 19, wherein each catch is substantially rectangular in shape.

21. A tile flooring system, as set forth in claim 20, wherein corners of the catches closest from a center of the tile are rounded.

22. A tile flooring system, as set forth in claim 20, wherein an outer edge of the tile within each catch includes three openings adapted to receive one of the extensions of the another modular interlocking tile.

23. A tile flooring system, as set forth in claim 22, wherein each catch includes at least one tab projecting from the outer edge of the tile.

24. A tile flooring system, as set forth in claim 23, wherein the at least one tab is adapted to securely fit into a first opening of the one of the extensions of the another modular interlocking tile.

25. A tile flooring system, as set forth in claim 24, wherein each catch includes at least one arm.

26. A tile flooring system, as set forth in claim 25, wherein the at least one arm is adapted to securely fit into a second opening of the one of the extensions of the another modular interlocking tile.

27. A tile flooring system, as set forth in claim 17, wherein each interlocking modular tile includes a support construction on a side opposite the playing surface.

28. A tile flooring system, as set forth in claim 17, wherein each interlocking modular tile includes a spider-web shaped construction on a side opposite the playing surface.

29. A modular interlocking tile for use in a tile flooring system, the modular interlocking tile being adapted to be coupled to another modular interlocking tile, comprising:

a body having a playing surface, two male interlocking sides, and two female interlocking sides; and, an interlocking mechanism coupled to the male interlocking sides and the female interlocking sides and having at least one extension on each male interlocking side and at least one catch on the female interlocking side, each extension including at least one first opening and two second openings, the first opening being adjacent the tile and at least one of the second openings being adjacent the first opening and an outer end of the extension.

30. A modular interlocking tile for use in a tile flooring system, the modular interlocking tile being adapted to be coupled to another modular interlocking tile, comprising:

a body having a playing surface, two male interlocking sides, and two female interlocking sides; and, an interlocking mechanism coupled to the male interlocking sides and the female interlocking sides and having at least one extension on each male interlocking side and at least one catch on the female interlocking side, each extension including first and second bars, two shorter sides, and a longer side, the first bar connecting the two shorter sides near a connection between the tile and the extension, the longer side being connected to an end of each shorter side, the second bar being connected between the first bar and the longer side.

* * * * *